United States Patent [19]

DeMasi et al.

[11] 4,262,827

[45] Apr. 21, 1981

[54] LADLE SHROUD APPARATUS

[75] Inventors: Gordon A. DeMasi, Michigan City; Richard A. Staats, Valparaiso, both of Ind.

[73] Assignee: Bethlehem Steel Corporation, Bethlehem, Pa.

[21] Appl. No.: 106,578

[22] Filed: Dec. 26, 1979

[51] Int. Cl.[3] ..... B22D 41/08

[52] U.S. Cl. ..... 222/607; 164/337

[58] Field of Search ..... 164/82, 437, 337; 222/590, 591, 598, 600, 601, 602, 606, 607

[56] References Cited

U.S. PATENT DOCUMENTS

| | | | |
|---|---|---|---|
| 3,460,725 | 8/1969 | Golde et al. | 222/607 X |
| 3,861,571 | 1/1975 | Franklin . | |
| 3,884,400 | 5/1975 | Tuschak et al. | 222/600 X |
| 3,907,022 | 9/1975 | Simons et al. | 222/606 X |
| 4,091,861 | 5/1978 | Thalmann et al. | 222/607 X |
| 4,131,220 | 12/1978 | Bode, Jr. et al. | 222/607 |

FOREIGN PATENT DOCUMENTS

| | | | |
|---|---|---|---|
| 2621557 | 4/1977 | Fed. Rep. of Germany | 222/607 |

*Primary Examiner*—David A. Scherbel

*Attorney, Agent, or Firm*—Joseph J. O'Keefe; Michael J. Delaney; Anson W. Biggs

[57] ABSTRACT

Apparatus for use in positioning a pouring tube on a bottom pour nozzle of a hot metal casting vessel including a pouring tube support carriage having universal or two dimensional movement in a horizontal plane and pouring tube transfer car mounted on the carriage to extend the pouring tube from an inboard position adjacent the carriage to an outboard position in alignment with the bottom pour nozzle. The apparatus is designed to raise and lower the pouring tube with respect to the bottom pour nozzle when in alignment therewith. The apparatus is also provided to move the pouring tube from an inboard vertical position to a horizontal travel position and finally to a vertical outboard position with the bottom portion of the pouring tube projecting into the molten metal bath of a tundish positioned beneath the casting vessel and the top of the pouring tube engaging the casting vessel bottom pour nozzle. The pouring tube transfer car is designed to be rapidly withdrawn in an emergency.

6 Claims, 5 Drawing Figures

LADLE SHROUD APPARATUS

BACKGROUND OF THE INVENTION

The present invention relates to a new and improved apparatus for positioning a shroud or pouring tube at a ladle or casting vessel bottom pour discharge nozzle and withdrawing the pouring tube therefrom when exchanging a pouring tube in normal operations or to rapidly withdraw the apparatus in an emergency situation.

It is known to use tubular shaped pouring tubes as a protective shroud around the hot metal stream flowing from a ladle or casting vessel. During the continuous casting of metals, for example, protective shrouds may be used between the casting vessel and the tundish and between the tundish and the continuous casting mold. The purpose of the protective shroud is to reduce ladle stream oxidation and to control a flowing ladle stream caused by throttling of a ladle slide gate. The shroud shields the molten metal stream issuing from the ladle from oxidizing effects of the ambient atmosphere and to permit use of a protective inert atmosphere such as argon if desired.

To reduce ladle stream oxidation a shroud holder has been devised so that shrouds made of refractory material, e.g. fused silica or alumina-graphite, could be mated to the slide gate collector nozzle of casting vessels so equipped. The mechanism was designed so that the shrouds could be easily removed for ladle changes or for lancing to open a new ladle.

Equipment has been devised for moving ladle shrouds or pouring tubes, as they will be referred to hereinafter, from a storage position to a position against the bottom of a casting vessel or ladle. Bottom pour ladles are equipped with a tubular nozzle connected to the bottom of the ladle through which hot metal may flow. Flow through the nozzle may be controlled by a slide gate valve and the pouring tube is seated against the slide gate valve to provide a protective shield around the hot metal stream flowing from the ladle nozzle to a tundish or other hot metal vessel when the slide gate is open.

In a continuous casting operation hot metal is transferred from a bottom pour ladle through a nozzle at the bottom of the ladle, a slide gate valve and pouring tube into a tundish which further directs the hot metal into moulds of the continuous casting machines. The lower end of the pouring tube is submerged below the level of hot metal in the tundish. Difficulties with placing the pouring tube in a vertical position against the ladle slide gate valve with the bottom immersed in the tundish bath because of the limited distance between the bottom of the ladle and the tundish cover have been overcome by moving the vertically disposed pouring tube from a storage location to a horizontal travel position and then finally into a vertical position aligned with the ladle nozzle and the tundish opening, the lower end of the pouring tube being submerged in the hot metal of the tundish.

Problems also arise when it is occasionally necessary to rapidly withdraw the transfer car from the vicinity of the ladle and tundish. Such problems include e.g. the occasion when the slide gate fails to function; failure of the tundish stopper rods; power failure, etc. In all of these situations major damage to the apparatus is a very real possibility. Equipment available heretofore for positioning pouring tubes at ladle bottom pour slide gate valves has not included provisions for a rapid withdrawal of the pouring tubes.

SUMMARY OF THE INVENTION

It is therefore an object of this invention to provide improved apparatus to accurately position a pouring tube in sealing engagement with a ladle bottom pour nozzle.

It is another object of this invention to provide apparatus for the rapid withdrawal of a pouring tube transfer car from a ladle.

It is a further object of this invention to provide apparatus for the removal of a pouring tube and its support means from a ladle bottom pour nozzle, having slideable closing means, during a power failure.

The present invention accomplishes these objects by providing an improved pouring tube support, which includes a movable support platform, a carriage having universal or two dimensional horizontal movement, and a pouring tube transfer car mounted on the carriage for movement of the pouring tube from an inboard position adjacent the carriage to an outboard position in vertical alignment with the ladle nozzle slide gate valve for engagement therewith. The pouring tube is carried in a holder mounted on the transfer car. The tube holder is semi-circular and open on one side to partially embrace the pouring tube. It is equipped with yieldable means on the open side so that rapid withdrawal of the pouring tube support is facilitated. The slide gate valve and the pouring tube transfer car are coupled together to operate as a unit during normal operation. Manual means for disconnecting this coupling is provided. The rapid withdrawal will result in the loss of the pouring tube but no further damage to the equipment occurs.

DESCRIPTION OF THE PREFERRED EMBODIMENT

Figure 1:
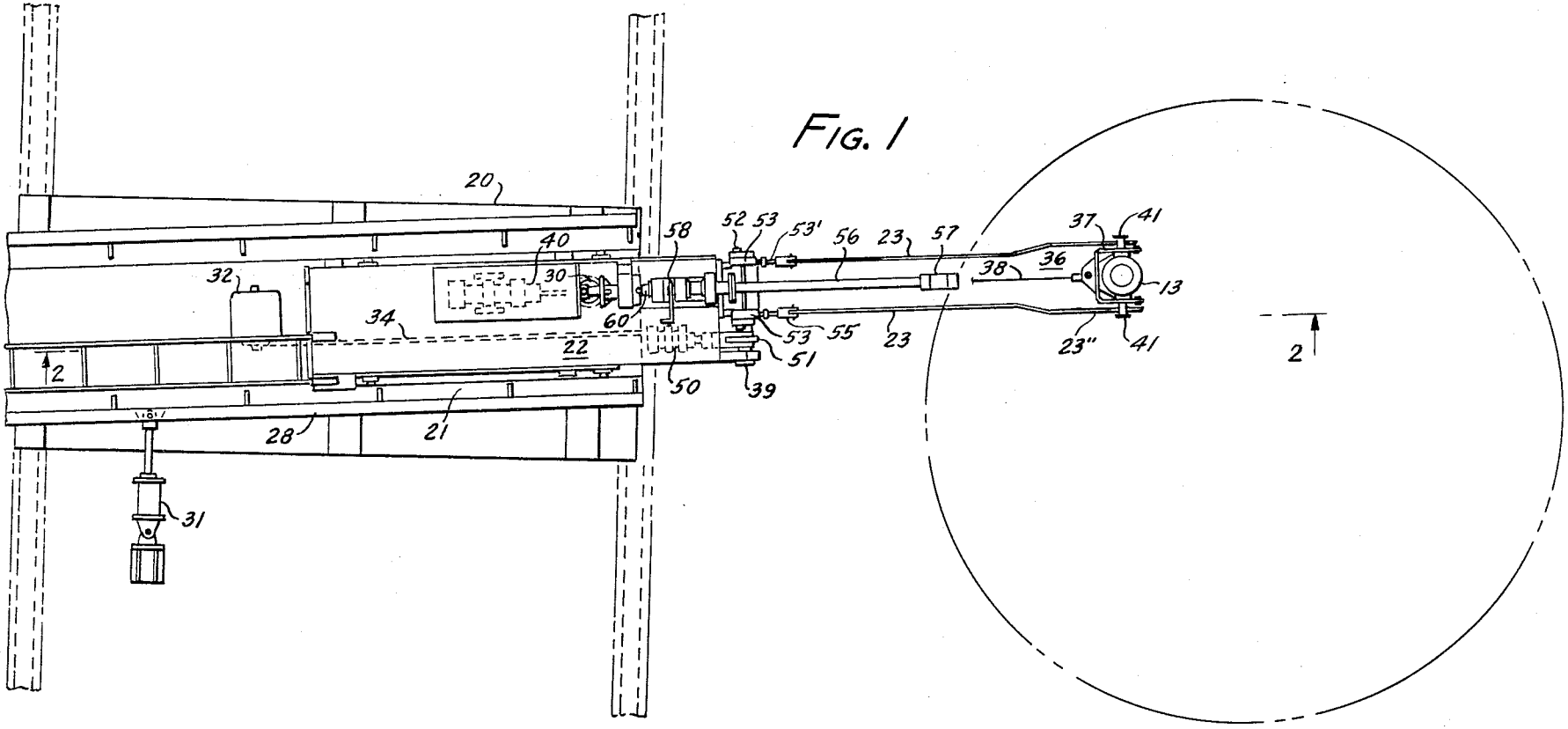
FIG. 1 is a schematic plan view of the pouring tube positioning apparatus.
Figure 2:
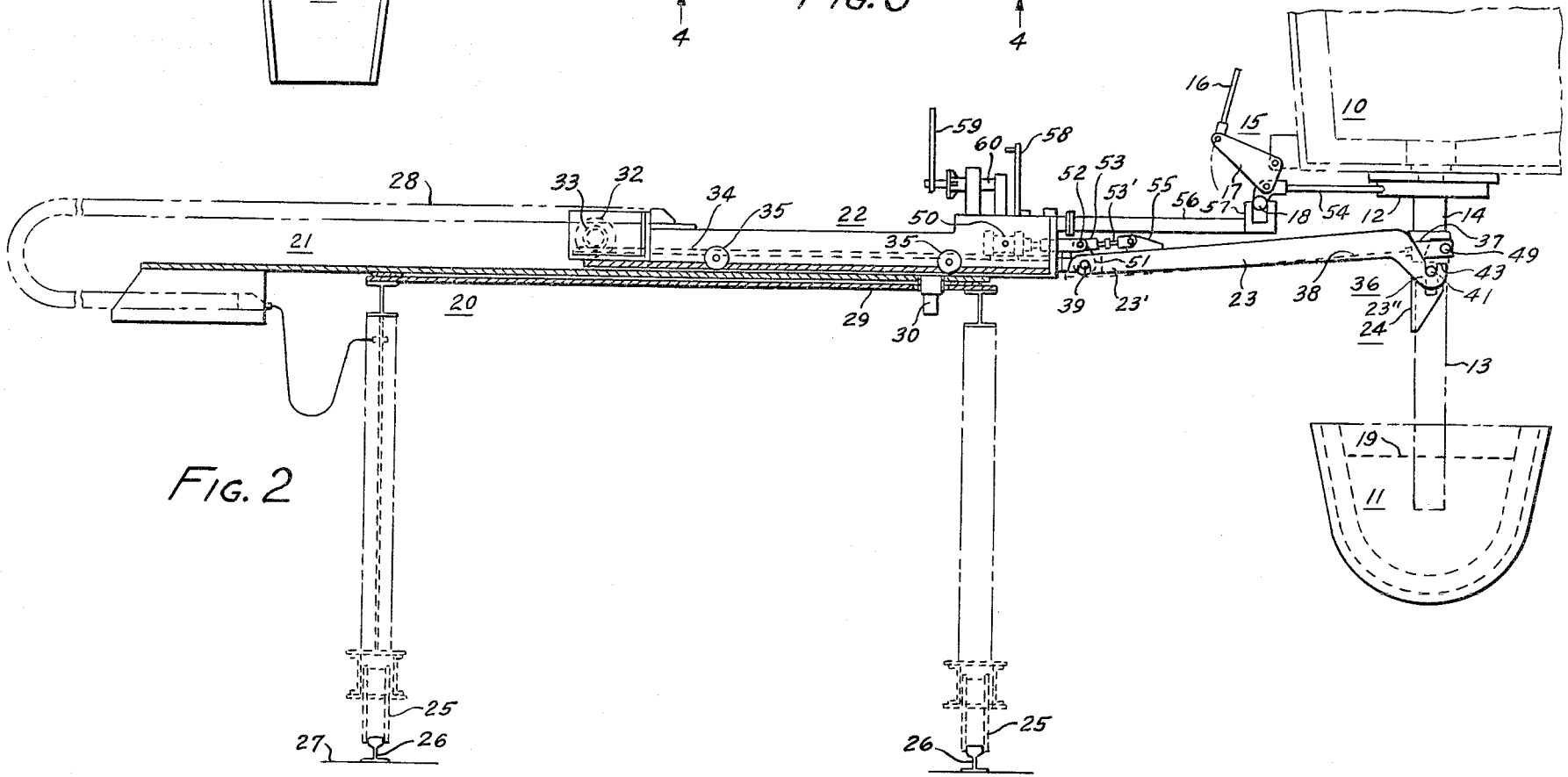
FIG. 2 is a side elevation taken on line 2—2 of FIG. 1.
Figure 5:
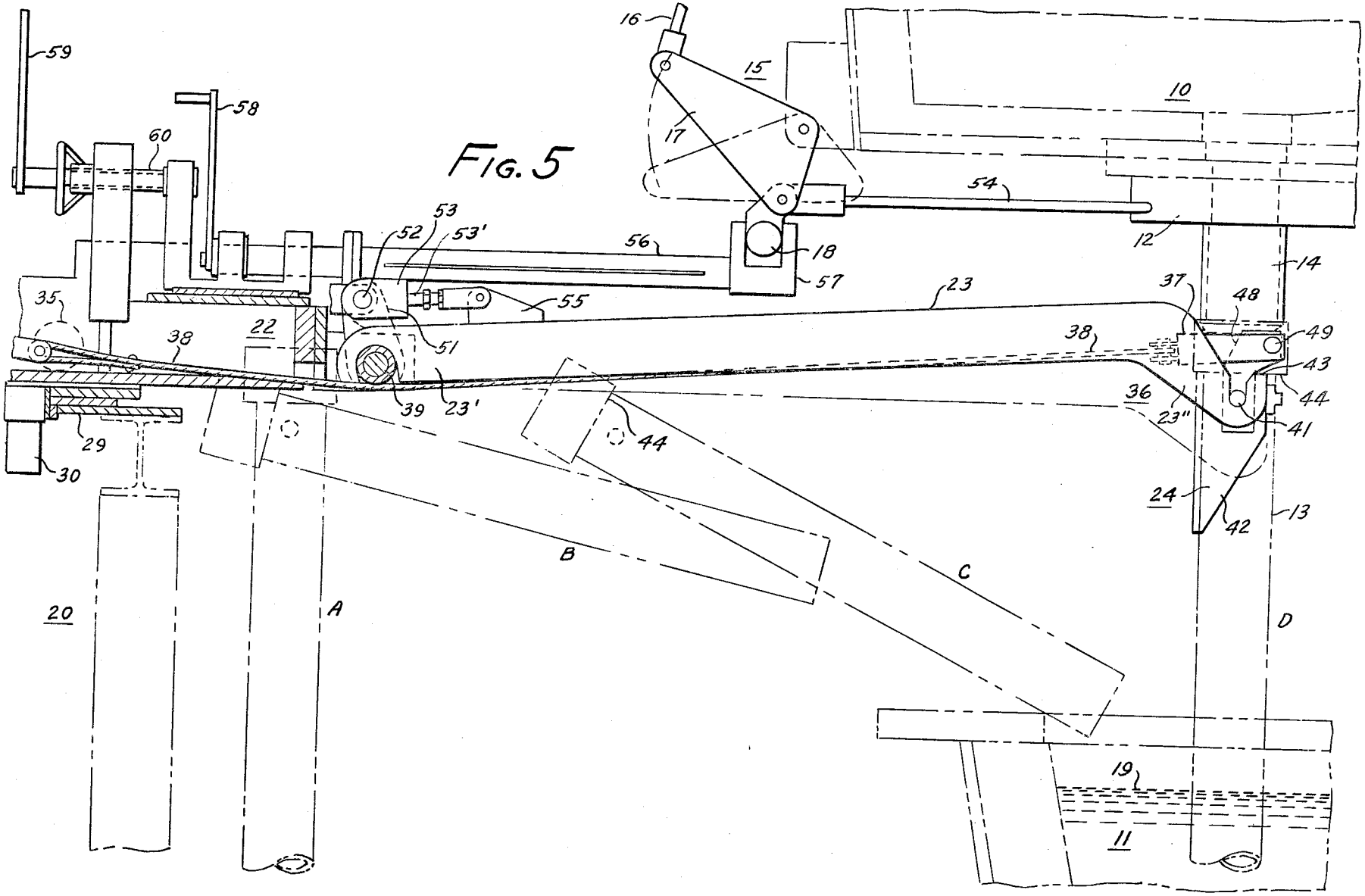
FIG. 5 is an enlarged fragmentary view of another portion of the apparatus of the instant invention.

Referring now to the drawings for a detailed description of the invention and particularly to FIGS. 1, 2 and 5 the invention is seen to include, generally, support platform 20, carriage 21, pouring tube support 36, and pouring tube transfer car 22.

Support platform 20 is mounted on wheels 25 for movement along the cast house floor 27 on tracks 26 by conventional prime mover means (not shown).

Carriage 21 mounted on support platform 20 comprises a frame 28 which houses the pouring tube transfer car 22. The carriage is provided with a pivot pin 30 adjacent one end thereof connected to support platform 20 through floor plate 29. Carriage rotate cylinder 31 is located at the opposite end of carriage 21 from pivot pin 30 and rotates the carriage about pivot pin 30.

Pouring tube transfer car 22 is provided with means for back and forth movement within the carriage 21 and includes pouring tube support means 36. The pouring tube support means 36 is extensible from an inboard position on the carriage 21 to a position outboard thereof (as shown in FIGS. 1 and 2) by means of the back and forth movement of the transfer car 22. The movement of the transfer car 22 is provided by a motor 32 mounted on transfer car 22 driving a pinion 33 on rack 34 which is affixed to the carriage 21. Transfer car 22 is provided with wheels 35.

Thus carriage 21 can be accurately positioned adjacent a work station as e.g. the bottom pour opening of a casting vessel because of the capability for universal or two dimensional movement of the carriage 21 in a horizontal plane.

Pouring tube transfer car 22 is devised to transfer a pouring tube 13, which may be a refractory material, e.g. fused silica or alumina-graphite, from a storage position wherein the transfer car is inboard of the carriage 21 to a position where the pouring tube 13 is in alignment with the slide gate nozzle 14. The pouring tube 13 is supported on pouring tube holder 24 mounted on the end of carrying arms 23 with the longitudinal axis of the pouring tube extending vertically when in the inboard storage position (position "A", FIG. 5) or in the outboard position in alignment with the slide gate nozzle 14 (position "D", FIG. 5). Between these two positions means is provided to rotate the pouring tube holder 24 so that the longitudinal axis of the pouring tube is substantially horizontal. Thus the pouring tube can be rotated from a vertical storage position to a horizontal travel position and return to a vertical outboard position for placement against the slide gate nozzle 14.

Pouring tube support means 36 comprises tube holder 24, to be described in detail hereinafter, yoke 37 pivotally attached to tube holder 24 and carrying arms 23. The inboard ends 23' of carrying arms 23 rest on pin 39 for rotation thereon and extend outboard of the carriage toward the ladle 10. Cable 38 is attached to the yoke 37 adjacent the outboard end 23" of the carrying arms 23 and to the rod end of hydraulic cylinder 40 mounted on transfer car 22. Retraction of the rod end of hydraulic cylinder 40 will cause cable 38 to rotate yoke 37 and tube holder 24 about trunnions 41. Pouring tube 13 rests in tube holder 24 and thus rotates with the holder from vertical to horizontal to vertical as desired.

Figure 3:
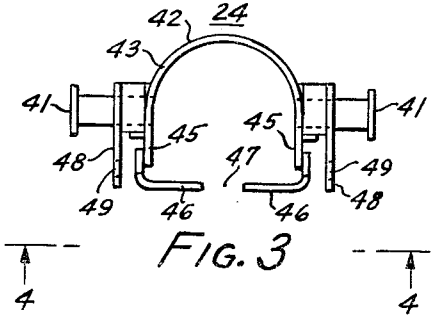
FIG. 3 is an enlarged fragmentary view of a portion of the apparatus of the instant invention.
Figure 4:
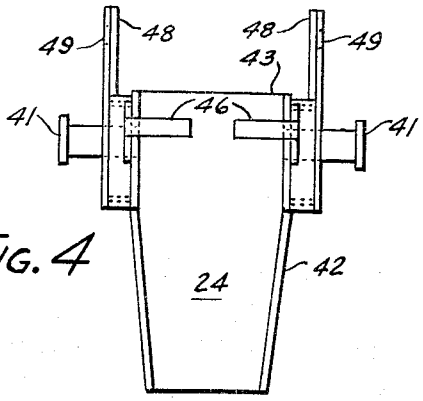
FIG. 4 is a detailed view of a portion of the apparatus taken on line 4—4 of FIG. 3.

Refer now to FIGS. 3 and 4 for a detailed description of pouring tube holder 24. The pouring tube holder 24 comprises a semi-circular, open-sided cannister 42 which partially embraces and supports a pouring tube 13.

The lower flanged surface 44 of the pouring tube 13 rests on the top horizontal surface 43 of the open-sided cannister 42. The semi-circular open-sided cannister 42 which in section resembles a U-shape partially embraces the pouring tube 13 below the lower flanged surface 44, the sides 45 of the cannister 42 extending as legs of the semi-circular or U-shape. Yieldable straps 46 attached to the sides 45 extend toward each other to effectively close the open side 47 of the cannister 42. Trunnions 41 are attached to either side of the cannister 42 near the top thereof closely adjacent the top horizontal surface 43. The trunnions 41 rotatably support the tube holder 24 and the pouring tube 13 resting therein on the outboard end 23" of the carrying arms 23. Links 48 mounted on the cannister 42 at the trunnion location and extending upwardly and outwardly therefrom provide a connection at pin hole 49 for yoke 37 wherein the tube holder 24 is operable by cable 38 to rotate holder 24 from a vertical to horizontal to vertical position as desired, all of which will be clearly understood by those skilled in the art.

Referring once again to FIGS. 1 and 2, the pouring tube 13 is seen resting in tube holder 24 at the outboard end 23" of the carrying arms 23 positioned in registry with the slide gate nozzle 10 by raising the carrying arms slightly from a substantially horizontal carrying position of the arms 23 of the transfer car 22. Hydraulic cylinder 50 mounted on transfer car 22 operates link 51 to rotate shaft 52 to which it is fixed. Rotation of shaft 52 moves links 53 which are also fixed to shaft 52, causing motion through rod 53' to plates 55 fixedly attached to the top of carrying arms 23. Slight movement of the rod on hydraulic cylinder 50 provides sufficient lift to the outboard end 23" of carrying arms 23 to lift the pouring tube 13 in registry with and against slide gate nozzle 14 or ladle nozzle.

As best seen in FIG. 2 the ladle 10 is shown positioned over tundish 11 with pouring tube 13 raised against slide gate nozzle 14 and in registry therewith. The lower end of pouring tube 13 is submerged into the molten metal bath of the tundish 11. Slide gate operating mechanism 15 comprises a hydraulic cylinder mounted on the ladle turret (not shown) which operates through a rod 16 to rotate bell crank 17 and operating rod 54 attached to the slide gate for moving the slide gate from a closed to an open position or vice versa. Operating rod 54 is provided with a pawl 18 for releasably connecting the slide gate 12 to the transfer car 22.

Slide gate connector rod 56 is mounted on transfer car 22 adjacent the inboard end 23' of carrying arms 23 and extends outwardly from the carriage 21 to make connection with pawl 18 on the end of operating rod 54. U-shaped connector block 57 is mounted on the end of connector rod 56 and is rotated manually by means of lever 58 from a horizontal position to a vertical position to engage pawl 18. The connection of pawl 18 and connector block 57 couples the transfer car 22 and ladle 10 into an operating unit. The power unit 32 for moving transfer car 22 back and forth on carriage 21 is neutralized to allow free wheeling of the transfer car 22 connected to ladle 10. Adjustment of slide gate connector rod 56 toward and away from the ladle 10 is accomplished through ratchet wrench 59 and screw 60.

In operation:

The apparatus of the instant invention for use in positioning a pouring tube (shroud) at the bottom opening of a bottom pour casting vessel is most clearly seen in FIG. 5. The apparatus is pictured in use in a continuous casting operation wherein the hot metal in ladle 10 is directed through a bottom opening in the ladle and, when open, through slideable closing means, i.e. a slide gate 12, thence through pouring tube 13 into tundish 11. The pouring tube 13 which is made of refractory material, e.g. fused silica or alumina-graphite, weighs about 100 lbs. when new and in this example is about 5'-6" long. The tube 13 is placed in sealing engagement with the slide gate collector nozzle 14 in a manner so as to prevent leakage of the hot metal. The lower end of pouring tube 13 extends a few inches below the top of the molten metal bath 19 in the tundish to prevent driving slag particles from the bath 19 downward and into the mould where the particles would form inclusions in the cast strand.

When the ladle 10 of hot metal is positioned over the tundish 11 in preparation for a casting operation the transfer car 22 is in the extreme retracted position, i.e.

inboard on the carriage 21. Pouring tube 13 is in the vertical "A" position in the pouring tube holder 24 and the pouring tube carrying arms 23 are in the extreme down position.

The operator actuates hydraulic cylinder 40 which rotates the pouring tube holder 24 from the vertical position "A" to the substantially horizontal position "B", FIG. 5. When the pouring tube is in position "B" the transfer car 22 is traversed from its position on carriage 21 toward the ladle 10 bottom opening. The pouring tube 13 in tube holder 24 is lowered through position "C" to vertical position "D". The operator will manually position the pouring tube 13 under the collector nozzle 14 of slide gate 12, making use of steering cylinder 31 which pivots the carriage 21 about pivot pin 30. The pouring tube is then raised to contact collector nozzle 14 in sealing engagement between the mating surfaces of the pouring tube and the collector nozzle 14. When a signal is received from the control state to raise the lift the traverse operation will go to a free wheeling condition. A mechanical coupling manually engages pawl 18 on slide gate operating rod 54 with connector block 57 on connector rod 56. After this mechanical coupling is made the free wheeling transfer car and the slide gate move together using the slide gate operating device.

Under normal conditions the operator will release the mechanical coupling and lower the pouring tube 13 away from the collector nozzle 14. When a signal is received from the control state to lower the lift, the free wheeling condition will automatically drop out.

The operator will traverse the pouring tube transfer car 22 inboard at high speed (approximately 18" per second) provided the lift is down based on a signal from control state and the pouring tube 13 is automatically rotated to the horizontal position "B". When the transfer car is stopped in the inboard (storage) position the pouring tube will automatically rotate to the vertical "A" position. If desired the operator can stop the traverse in an intermediate position so that the pouring tube can be lanced and the ladle changed for series casting. The automatic operations are controlled by limit switches as will be clearly understood by those skilled in the art.

In case of an emergency, as e.g. power failure, leaking stopper rods, etc., a quick release feature is set in motion. The mechanical coupling is manually released by the operator and the free wheeling is manually released and the transfer car 22 is traversed away at high speed under manual control. The pouring tube is not lowered away so that when the transfer car is traversed away the yieldable straps on the open side of the tube holder 24 will bend open, allowing the holder to be pulled away from the pouring tube 13. The pouring tube thereafter drops away and is sacrificed. Therefore, little or no damage is sustained by the equipment.

The apparatus of the instant invention replaces cumbersome, slow and unreliable means for transporting and attaching tubes for shrouding liquid metal streams. The apparatus provides rapid, accurate, reliable and repeatable placement of the pouring tube on the ladle nozzle and into steel in an intermediate vessel, i.e. tundish, etc.

The apparatus is quickly removed by means of a stored energy vessel (accumulator) and quick release feature, which bypasses normal disengagement steps in case of an emergency or electrical and hydraulic failure.

The portions of the apparatus exposed to hot metal are designed to be expendable, inexpensive and easily replaced.

The apparatus comprises a carriage, a pouring tube transfer car and electrical and hydraulic controls and guide assembly. It can function with hydraulic backup control levers in the event of electrical failure. In the event of electrical and hydraulic failure it can through hydraulic energy stored in an accumulator detach itself from the pouring tube and intermediate vessel (tundish). It can then store itself in a remote location.

The guide assembly provides tracks and rack to guide and drive the pouring tube transfer car. This assembly also provides lateral steering through a hydraulic cylinder.

The pouring tube transfer car 22 consists of wheels and a hydraulic motor driver pinion which ride in the guide assembly and mesh with the track to transfer the motive power. Also on the transfer car are hydraulic cylinders which transfer rotational and vertical movement to the pouring tube.

We claim:

1. In apparatus for use in positioning a pouring tube at the bottom opening of a casting vessel, the improvement comprising:

(a) a carriage positioned adjacent the casting vessel and having two dimensional movement in a horizontal plane, (b) pouring tube support means mounted on the carriage extensible from an inboard position on the carriage to an outboard position thereof, (c) an open-sided pouring tube holder mounted on the outboard end of the support means to partially embrace and support the pouring tube, and (d) means mounted on the carriage to raise and lower the pouring tube with respect to the bottom opening of the casting vessel.

2. Apparatus according to claim 1 further including:

(e) means mounted on the carriage to rotate the pouring tube from a vertical position to a horizontal position and return to a vertical position.

3. Apparatus according to either claim 1 or 2 wherein the open-sided pouring tube holder of subparagraph (c) includes yieldable straps extending from the sides of the pouring tube holder toward the center of the open side to substantially close the open side of the holder.

4. In apparatus for use in positioning a pouring tube at the bottom opening of a casting vessel having slideable closing means mounted adjacent the bottom opening, the improvement comprising:

(a) a carriage positioned adjacent the casting vessel and having two dimensional movement in a horizontal plane, (b) pouring tube support means mounted on the carriage extensible from an inboard position of the carriage to an outboard position thereof, (c) an open-sided pouring tube holder mounted on the outboard end of the support means to partially embrace the pouring tube, (d) means mounted on the carriage to raise and lower the pouring tube with respect to the slideable closing means, and (e) releasable connecting means between the carriage and the casting vessel slideable closing means.

5. Apparatus according to claim 4 further including:

(f) means mounted on the carriage to rotate the pouring tube from a vertical position to a horizontal position and return to a vertical position.

6. Apparatus according to either claim 4 or 5 wherein the open-sided pouring tube holder of subparagraph (c) includes yieldable straps extending from the open ends of the open-sided holder toward the center of the open side to substantially close the open side of the holder.

* * * * *